United States Patent [19]

Torii

[11] 3,961,648

[45] June 8, 1976

[54] POSITIVE SHEDDING MOTION DEVICE FOR A CIRCULAR LOOM

[75] Inventor: Soichi Torii, Kyoto, Japan

[73] Assignee: Torii Winding Machine Co., Ltd., Kyoto, Japan

[22] Filed: Apr. 24, 1974

[21] Appl. No.: 463,438

[30] Foreign Application Priority Data

Oct. 11, 1973 Japan ..... 48-114504

[52] U.S. Cl. ..... 139/13 R

[51] Int. Cl.² ..... D03D 37/00

[58] Field of Search ..... 139/11, 12, 13, 14, 139/15, 16, 55, 57

[56] References Cited

UNITED STATES PATENTS 2,487,148 11/1949 Latieule et al. ..... 139/13

FOREIGN PATENTS OR APPLICATIONS 506,966 11/1951 Belgium ..... 139/13

1,035,227 7/1966 United Kingdom ..... 139/11

*Primary Examiner*—Henry S. Jaudon

*Attorney, Agent, or Firm*—Paul & Paul

[57] ABSTRACT

A circular loom for tape yarn consists of a plurality of shuttles arranged horizontally, and a pair of guide rings arranged at the center of the loom for supporting the inner side of said shuttle, a shuttle race arranged concentrically to said guide rings and which guides the outer portion of the shuttle, a plurality of the heald frames arranged outside of said shuttle race, and provided with a plurality of healds, and a positive shedding device for inducing the shedding motion of the heald frames, which is operated by means of a heald lifting projection provided on a rotating cam disc.

1 Claim, 11 Drawing Figures

POSITIVE SHEDDING MOTION DEVICE FOR A CIRCULAR LOOM

The present invention relates to a positive shedding motion device for heald frames, which are used for a circular loom in the manufacture of tubular fabrics from tape yarn and the like.

A flat fabric similar to the tubular fabric of plain weave design manufactured on a circular loom which is provided with the shuttle and pushing apparatus for said shuttle of the present invention, is now being manufactured on any type of conventional loom or shuttleless loom, such as a rapier loom or the like.

Within a tubular fabric, the distance between the neighbouring warp tape yarns is inversely proportional to the number of warp yarns within the tubular fabric. This is because the diameter of said fabric manufactured on one loom is always the same even if such fabric is woven from different numbers of warp yarns or various tape yarns of different width.

All circular looms must be provided with a heald shedding motion. One type of circular loom presently in use is provided with a heald shedding mechanism, which consists of an upper cam and a lower cam with curved surfaces which are symmetrical to each other, and also cam followers which are moved up or down in accordance with the rotation of said cams, so that a pair of heald frames are moved in different directions from each other. One of the drawbacks of the arrangement is that the mechanism which includes the arrangement of the heald frame and the cam follower, and also the connecting mechanism between them, is complicated. A further drawback is that the movement of the healds is not reliable and noise is generate during the operation of the heald shedding device. This heald shedding device consists of many cam followers, each being engaged with either the upper cam or lower cam, and mechanically connecting members which connect the heald frames and the corresponding cam followers. This complicated mechanism of said heald shedding device restricts high speed operation of the circular loom to a speed at which said device will run smoothly.

The object of the present invention is to provide a positive heald shedding device, which has none of the abovementioned drawbacks and which is of simple construction. In addition to this, the connection between the cam follower and the heald frame is also very simple and, therefore, the running of this device is very silent.

Further features and advantages of the present invention will be clear from the ensuing description, reference being made to the accompanying drawings, wherein:

FIGS. 6 and 7 are sectional views of the arrangement of the positive shedding motion device and the heald frames as shown in FIG. 5, but FIG. 6 shows the condition when the outside heald frame is lifted, while FIG. 7 shows the condition when the inside heald frame is lifted.

Generally, when a tubular fabric with, for example, a circular peripheral length of 1,200 mm, is made of tape yarn with, for example, a width of 1.5 mm, then 800 warp tape yarns or less (1,200/1.5 = 800) must be prepared. Such number of the warp yarns are withdrawn and unwound from the beam or the packages mounted on the creel, and fed to the fell of the woven tubular fabric from all directions of the circle.

Such feeding of the warp yarns is generally by means of the two warp feeding devices which are arranged on both sides of the circular loom. In the circular loom, the shuttle with one weft yarn package may pass through the shed which is defined by the upper warp yarn sheet and the lower warp yarn sheet, and by the movement of said shuttle the weft yarn is laid as near as possible to the fell of the tubular fabric. When the relative relationships of the warp yarn sheets are altered, said weft yarn can be woven into a fabric of plain design.

The warp yarn density and the weft yarn density within a tubular fabric generally is 16 warp yarns and 16 weft yarns per 25 mm width and length of the fabric, respectively, and sometimes it is 12 or 14 warp and weft yarns per 25 mm.

Figure 1:
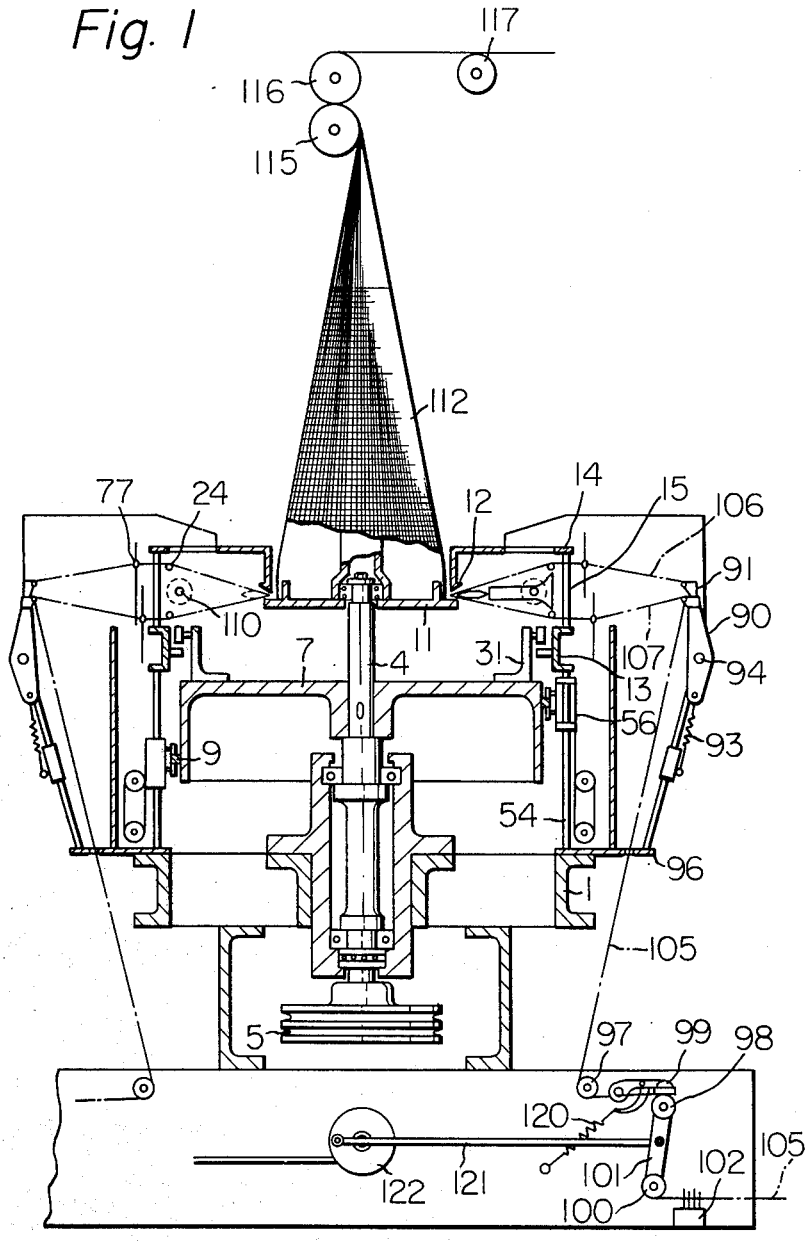
FIG. 1 is a sectional view of a circular loom which is provided with the device of the present invention.

In the case of weaving such tubular fabric from tape yarn, a circular loom of the present invention, as shown in FIG. 1, is used. On such a circular loom, a plurality of warp yarns 105, unwound from the two groups of the warp yarn packages, are fed to the loom after passing through the warp feeding devices, provided on both sides of the loom. Such a warp feeding device consists of a comb guide 102, a unit of the braking roller 98, a swing arm 101, a swing guide roller and a braking shoe apparatus 99, and also a unit of a connecting rod 121 and a driving disc 122. After leaving said feeding device, the warp yarns can enter the holes of the perforated plate 96 from the surface of the guide roller 97. Such perforated plate 96 is situated above the level of said guide roller 97, but below the warp line of the warp yarns.

Figure 2:
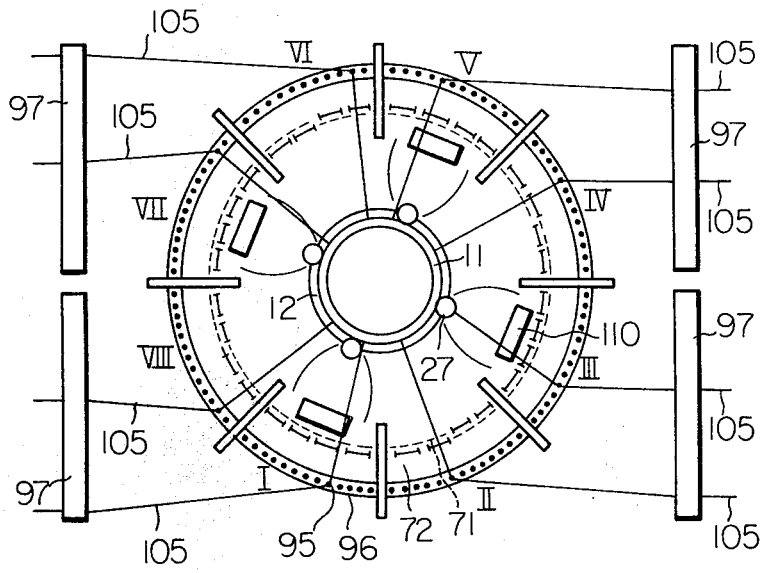
FIG. 2 is a plane view of the circular loom shown in FIG. 1, which shows an arrangement of the warp yarns, the shuttles and the heald frames.

A plurality of holes, the number of which is the same as or more than the number of warp yarns, are provided on the perforated plate 96. By these holes on the perforated plate 96 all of the warp yarns can extend from the surface of the warp yarn guide roller 97 to the holes of the perforated plate 96. One half of the warp yarns are guided by one of the warp yarn guide rollers 97, on which said yarns are arranged side by side, and afterward they are rearranged such that each warp yarn passes through one of the holes on the perforated plate 96. Then all of the warp yarns are directed upward, so that they form a cone, with its larger diameter at the top. At the top of said cone the same number of guiding members are arranged on the members 90 as the number of warp yarns. At the same level as said top of the cone a guide ring 11 is mounted on the shaft 4. By this arrangement the warp yarn can extend from the hole of the perforated plate 96 to the guiding member on the member 90, and then enter the circular fell of the woven tubular fabric 112, which is guided by said guide ring 11. As shown in FIG. 2, all of the warp yarns are divided into eight groups, i.e., eight sections I through VIII, that is, each of the warp yarns shown in FIG. 2 represents all of the warp yarns within one section. Four shuttles are arranged concentrically with equal angular distance therebetween.

Figure 4:
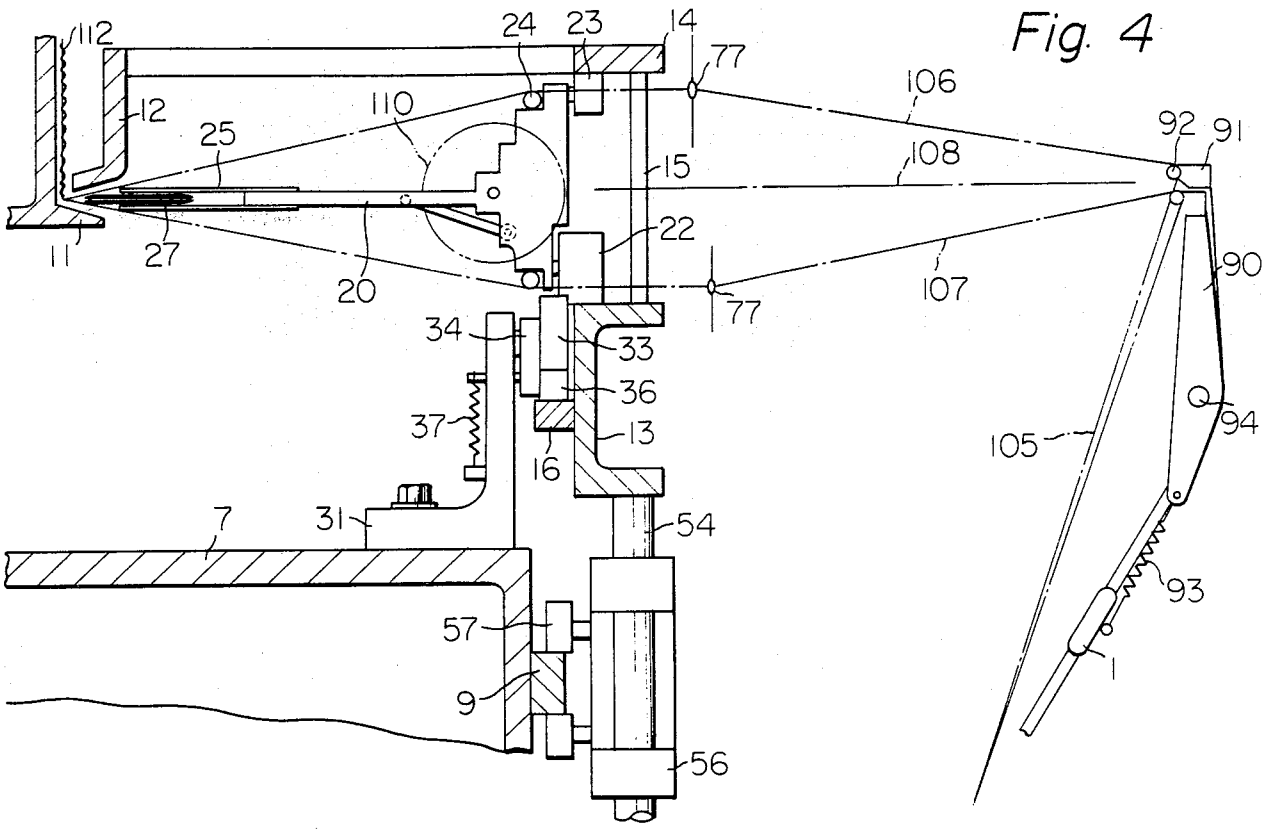
FIG. 4 is a detailed sectional side view showing the main functional parts in the circular loom as shown in FIG. 1.

As shown in FIG. 4, all of the warp yarns are divided into two sheets of warp yarns 106 and 107. One of the two sheets will be lifted while another will be lowered from the level of the warp line 108 by the so called shedding motion device, so that an upper warp yarn sheet and a lower warp yarn sheet are formed. When all of the warp yarns 105 are divided into an upper warp yarn sheet 106 and a lower warp yarn sheet 107, a transverse opening of triangular shape is formed between them, and through this opening a shuttle with one weft package 110 can travel along the horizontal circular path. By the circular movement of the shuttle the weft yarn unwound from the weft yarn package 110 on the shuttle can be laid as near as possible to the fell of the tubular fabric 112, so that said weft yarn 111 can be woven into the tubular fabric 112 in a plain weave design. The tubular woven fabric 112 thus woven can be lifted and folded into a flattened tubular fabric and then taken up by means of a pair of take up rollers 115 and 116 as shown in FIG. 1. After that the fabric travels over the upper surface of the delivery guide roller 117 and then it can be transported to a winding apparatus, cutting apparatus, fusing apparatus or printing machine.

One typical arrangement of the shuttle is shown in FIG. 4. In the arrangement of FIG. 4 a shuttle race consists of a bottom shuttle race 13, the cross section of which is shaped like a block "C," and a top shuttle race 14 shaped like a large ring. Between the top shuttle race 14 and the bottom shuttle race 13, which are of the same diameter, a plurality of shuttle guide rods 15 are vertically arranged with equal distance therebetween, so that a warp yarn can freely pass between the neighbouring rods 15. The height of said rods 15 must be equal to or slightly longer than the maximum height of the shed of warp yarn.

The diameters of said top and bottom shuttle races 13 and 14 are larger than the diameter of the inner and upper guide rings 11 and 12. Said shuttle races 13 and 14 and said guide rings 11 and 12 are arranged concentrically, and between them a shuttle is mounted.

At a lower level than that of said shuttle, shuttle race and guide rings, a cam disc 7 is mounted on the shaft 4, so that it can rotate together with the shaft 4. On the outside surface of said cam disc 7 a curved heald lifting projection 9, which acts as the source of the shedding motion for the warp yarn, is provided. The turning motion of said cam disc 7 is induced by a motor not shown, via a pulley 5 as shown in FIG. 1.

Figure 3:
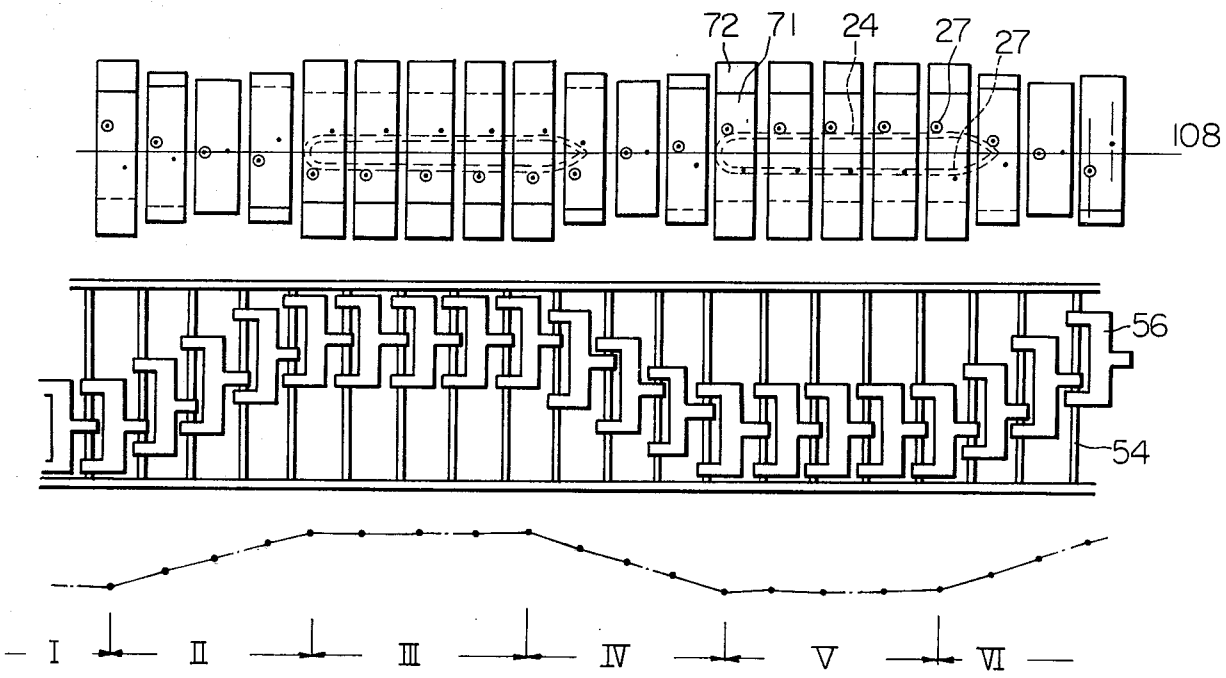
FIG. 3 is an explanatory and developed view showing the relationship of a plurality of shuttles, a plurality of pairs of heald eyes, and the shedding elements in the present invention.

In the circular loom as shown in FIG. 1, a plurality of guide rods 54 are arranged between the bottom surface of the bottom shuttle race 13 and the upper surface of the frame 1, and slidably mounted on each guide rod 54 is a sliding piece 56. As shown in FIG. 3, said sliding pieces 56 are displaced upwardly and downwardly along the guide rods 54, which displacement is induced by the curved surface of the heald lifting projection 9 provided on the cam disc 7 as shown in FIG. 4. This curved surface is indicated in the lower part of FIG. 3 by dots at different heights connected by a solid line.

As shown in FIG. 4, a plurality of eyes 77 on the heald wires, are arranged outside of the shuttle race (13, 14 and 15). As said eyes 77 on the heald wires are mounted on the heald frames (not shown in FIG. 4) and said heald frames are connected to said sliding pieces 56 by means of connecting members (not shown), when one of the heald frames 71 shown in FIG. 3 is moved upward, one of the heald frames 72 is moved downward, so that the relative positions of the eyes 77 of the heald frames 71, which are indicated by the solid dot in FIG. 3, and the eyes 77 of the heald frames 72, which are indicated by the dot and circle, can be altered according to the upward or downward movement of the sliding pieces 56, the movement of which is induced by the heald lifting projection 9 on the cam disc 7 as shown in FIG. 4. As shown in FIG. 3, the warp guide rod 24 of the shuttle, shown by a broken line, is always arranged in the position, where the shed is open, and the warp yarns guided by the eyes 77 are always in contact with the upper and lower horizontal portions of the warp guide rod 24. By this means the shedding of the warp yarn 105 shown in FIG. 4 can be accomplished.

Figure 8:
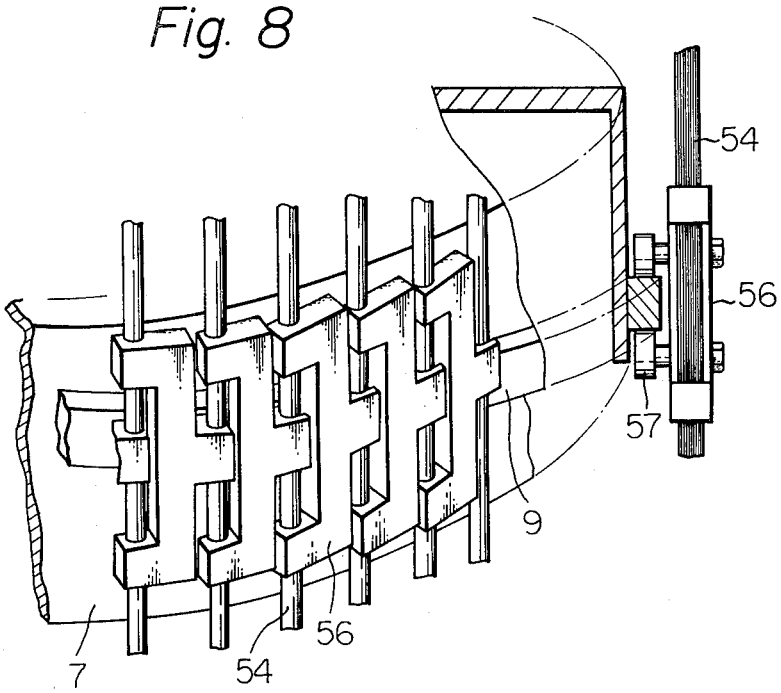
Figure 9:
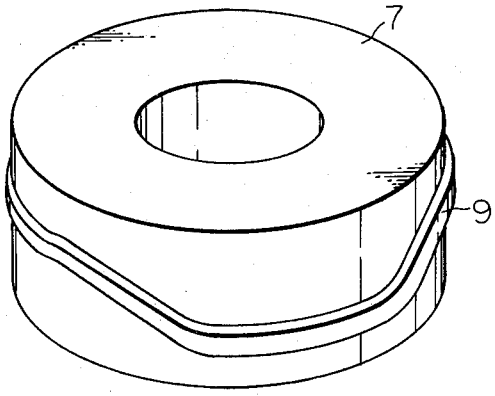
Figure 10:
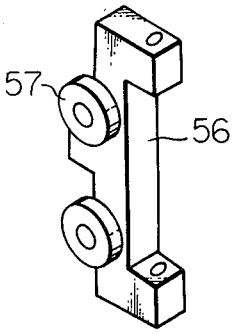

As shown in FIGS. 4 and 10, to shed the warp yarn 105 the positive shedding device of the present invention consists of a sliding piece 56, on the side of which an upper and a lower rollers 57 and 57' are provided. Said rollers are in contact with the upper and lower surfaces of the heald lifting projection 9, respectively. As shown in FIGS. 8 and 10, to slide said sliding piece 56 on the guide rod 54, there are two portions projected an one side of said sliding piece and one projected portion projected on the opposite side of said sliding piece mid-way between said two projected portions. Each projected portion is provided with a sliding hole through which adjacent guide rods 54 are inserted. As can be seen in FIG. 8, one sliding piece 56 is guided by two adjacent guide rods 54. Both the plurality of guide rods 54 and the plurality of sliding pieces 56 are arranged vertically parallel. Guide rods 54 are inserted through the holes of said two projections of the sliding piece 56 and also through the hole of said mid-way projection of the adjacent sliding piece 56 and are mounted one after the other.

Figure 5:
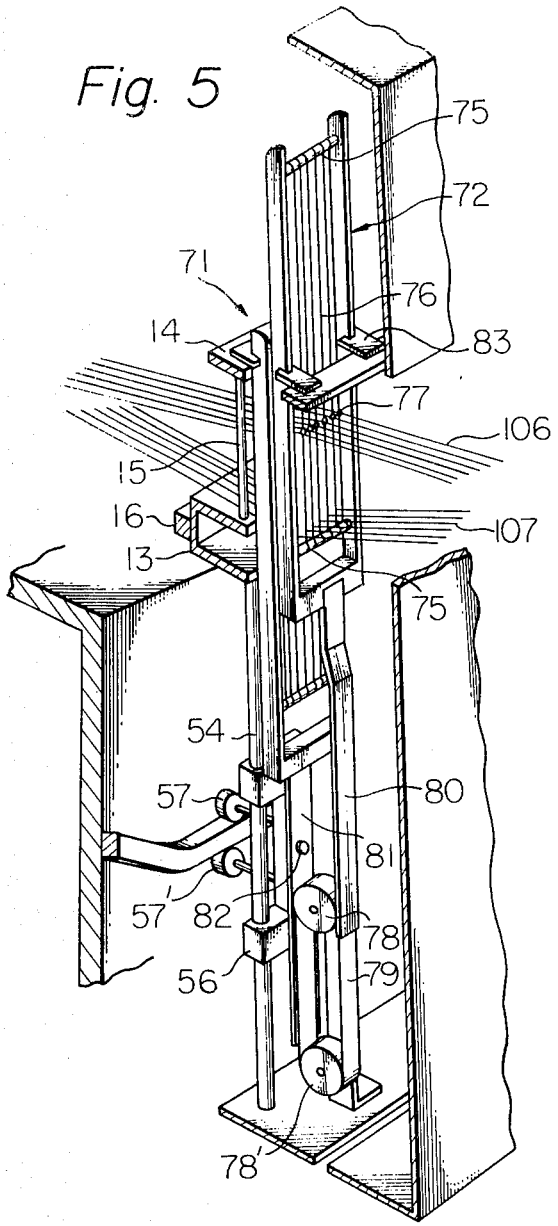
FIG. 5 is a perspective view of the positive shedding motion device and the heald frames of the present invention.
Figure 5A:
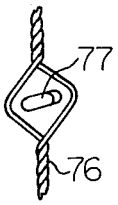
FIG. 5A shows an eye of the heald frame suitable for the tape yarn.
Figure 6:
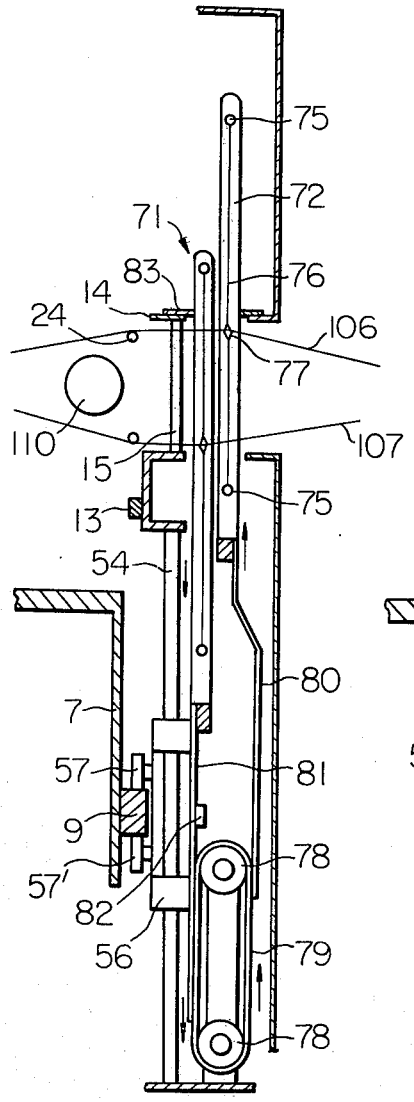
Figure 7:
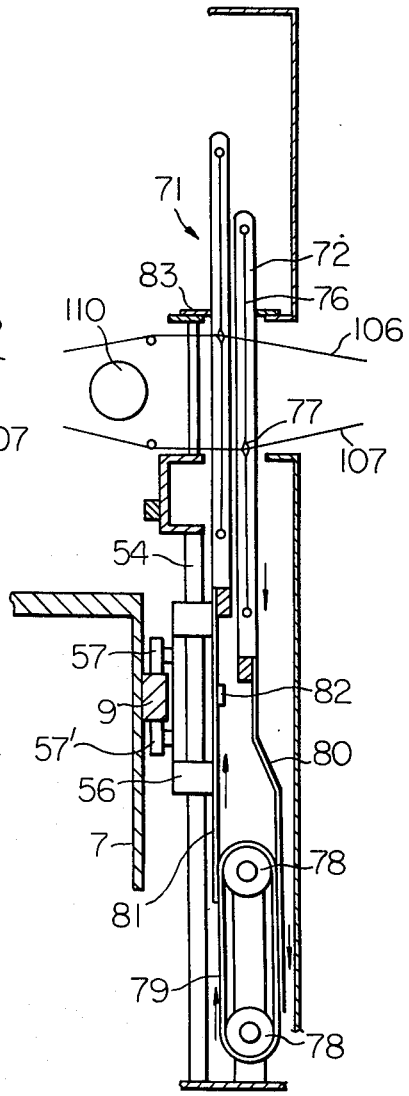

As shown in FIG. 5, an inner heald frame supporting sheet 81 is secured on the outer side surface of the sliding piece 56 at its center by means of a connecting pin 82, but its upper end is fixed to the bottom of an inner heald frame 71 and its lower end is mounted by proper connecting means (not shown) to the outer surface of an endless belt 79. This endless belt 79 is mounted between two guide pulleys 78 and 78' supported by a bracket (not shown), as shown in FIGS. 5, 6 and 7 so as to be capable of moving forward and backward. The top of an outer heald frame supporting sheet 80 is fixed at the bottom of an outer heald frame 72, and the bottom of said sheet 80 is mounted by proper connecting means (not shown) to the outer surface of the endless belt 79 in such an arrangement that the inner heald frame supporting sheet 81 and the outer heald frame supporting sheet 80 are mounted on the endless belt 79 and equal distance apart in either direction. A heald frame guide plate 83, which guides the inner and outer heald frames 71 and 72 at their upper portions, is mounted just above the upper surface of the top shuttle race 14, so that the heald frames 71 and 72 are maintained in their given positions near the outside of the shuttle race, even if they are moved upwardly and downwardly. A plurality of heald wires 76, each of which is provided with one eye 77 at its center, is assembled on the heald frame by means of the upper and lower heald supporting rods 75 mounted on said heald frame. Each eye 77 preferably has an elongated shape as shown in FIG. 5A, which is perpendicular to the lengthwise direction of the heald wire 76. An eye 77 of this shape is preferable because, after a tape yarn has passed through eye 77 of this shape, the flat surface of a warp yarn 105 is always horizontal.

As the positive shedding motion device of the present invention is contracted as mentioned above, the movement of the sliding piece 56 is induced positively by the heald lifting projection 9 during the rotation of the cam disc 7, and said positive movement can be transported to the inner heald frame 71, while the inversely positive movement can also be transported to the outer heald frame 72 via the mechanism of the endless belt 79 and the outer heald frame supporting sheet 80. Of course, the traversing directions of the inner and outer heald frames 71 and 72 should be opposite each other, while the amount of travel of each is equal. Because all of the movements of the heald frames are effected positively, the movements of the heald frames are very reliable, and this reliability can be expected even when the circular loom is run at high speed. This means that a reliable shedding motion for the warp yarn is realized.

As shown in FIG. 2, in a circular loom provided with the positive shedding motion device of the present invention, four shuttles are arranged at four positions and the heald frames are divided into eight sections, I through VIII. Each section consists of four pairs of heald frames, and one heald frame contains twelve head wires. This means that ($12 \times 2 \times 4 \times 8 =$) 768 warp yarns 105 can be fed to the circular loom.

As shown in FIGS. 2 and 3, at the sections I, III, V and VII the warp yarns 105 are in the open shed condition, while at the sections II, IV, VI and VIII the warp yarns 105 are in the altering shed condition, and four shuttles are positioned corresponding to the sections I, III, V and VII, respectively. As an example, a weft yarn III extended from the shuttle at the section III to the fell of the tubular fabric 112 can be woven into the fabric 112 within the section II, because in said section the relative relation of the upper and lower warp yarn sheets are altered by the shedding motion. Consequently, with the present invention during one revolution of the cam disc 7 four weft yarns 111 can be woven into a fabric.

One of the features of the positive shedding motion device of the present invention is that, only a single heald lifting projection 9 is necessary, and this projection 9 is mounted on the cam disc 7, by which all of the shuttles on the circular loom are moved. A further feature is that the shedding motion for the heald frames can be induced by means of a traversing mechanism of very simple construction, consisting of a sliding piece and a guide rod, a supporting sheet and an endless belt, which results in very quiet running of the positive shedding motion device of the present invention.

What is claimed is:

1. A positive shedding motion device for a circular loom for tape yarn, wherein said circular loom is provided with a shuttle guide ring apparatus at the center of the loom, a shuttle guide race device which is arranged concentrically with said shuttle guide ring apparatus, a shuttle which is mounted between said guide ring apparatus and said shuttle guide race device, and is moved by the rotation of a cam disc and a warp yarn guide which is positioned at the outermost apex of the warp yarn shed and at the outermost ends of the warp lines of the warp yarns which are arranged horizontally, and each pair of inner and outer heald frames and the driving device therefore comprises an inner heald frame, which is provided with a supporting sheet secured on the side of a sliding piece moving up and down and also mounted on one side of an endless belt, an outer heald frame, which is provided with a supporting sheet mounted on another side of an endless belt, an endless belt onto the surface of which an outer heald frame supporting sheet and an inner heald frame supporting sheet are mounted, respectively, and a pair of upper and lower guide pulleys arranged in a vertical arrangement and around both pulleys said belt is mounted, wherein said device comprises, several sections of heald frames arranged on one complete circle, wherein each section consists of a plurality of inner and outer heald frames.

* * * * *